United States Patent [19]

Flum et al.

[11] 4,384,741

[45] May 24, 1983

[54] TILTING DEVICE FOR SEATING UNITS

[75] Inventors: Manfred Flum, Weilheim; Horst Ziegler, Albbruck, both of Fed. Rep. of Germany

[73] Assignee: Christof Stoll GmbH & Co. KG, Waldshut-Tiengen, Fed. Rep. of Germany

[21] Appl. No.: 183,644

[22] Filed: Sep. 3, 1980

Related U.S. Application Data

[63] Continuation-in-part of Ser. No. 952,791, Oct. 19, 1978, abandoned.

[30] Foreign Application Priority Data

Oct. 29, 1977 [DE] Fed. Rep. of Germany ..... 2748680

[51] Int. Cl.[3] ..... A47C 3/00

[52] U.S. Cl. ..... 297/304; 297/328; 297/365

[58] Field of Search ..... 297/328, 301, 304, 305, 297/300, 316, 365, 367

[56] References Cited

U.S. PATENT DOCUMENTS

| | | | |
|---|---|---|---|
| 2,319,700 | 5/1943 | Miller et al. | 297/328 |
| 2,321,385 | 6/1943 | Herold | 297/301 |
| 2,447,601 | 8/1948 | Sengpiel | 297/301 |
| 2,471,024 | 5/1949 | Cramer | 297/301 |
| 2,650,646 | 9/1953 | Herold et al. | 297/301 |
| 3,034,828 | 5/1962 | Kurihara | 297/304 |
| 3,434,756 | 3/1969 | Walkinshaw | 297/300 |

FOREIGN PATENT DOCUMENTS

| | | | |
|---|---|---|---|
| 2642739 | 9/1976 | Fed. Rep. of Germany | 297/328 |

*Primary Examiner*—Francis K. Zugel

*Attorney, Agent, or Firm*—Oblon, Fisher, Spivak, McClelland & Maier

[57] ABSTRACT

A compact, optically inconspicuous tilting device for seating units, to be attached underneath a seat including a casing disposed beneath a seat resting on the understructure of the seating unit, a seat carrier pivotably mounted about a horizontal axis to the front edge area of said seat, mechanical locking means for connecting the seat carrier within the casing including first locking members successively arranged in at least two planes parallel to the swivel axis of the seat carrier and staggered towards each other and second locking members engageable with said first locking members, a rest member connected to said casing including a shank member, a link member interconnecting said seat carrier with the shank member, a bearing member connected to said casing operably engageable with said shank member to the rest member, at least one spring element mounted on said casing which acts at one end of the seat carrier opposite to the load of the user, and bistable activation lever means for activating said mechanical locking means, accessible to the user of the seat unit in such a manner that, in a first operable position, said second locking members are disengaged from said first locking members and, in a second operable position, at least one of said second locking members is engaged with said first locking members.

5 Claims, 12 Drawing Figures

Fig. 1A
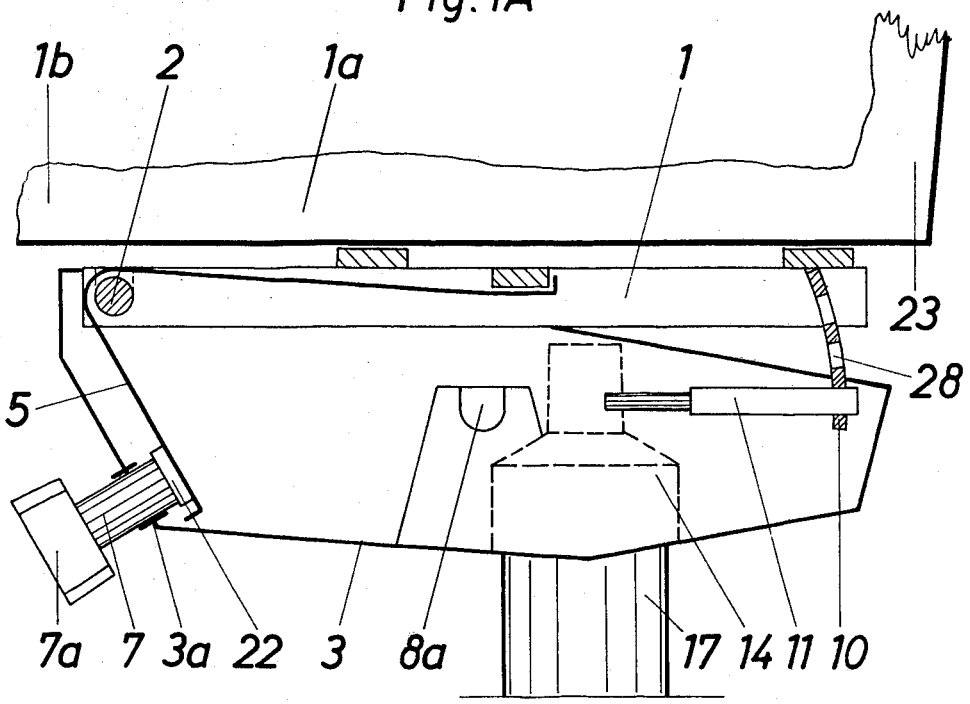
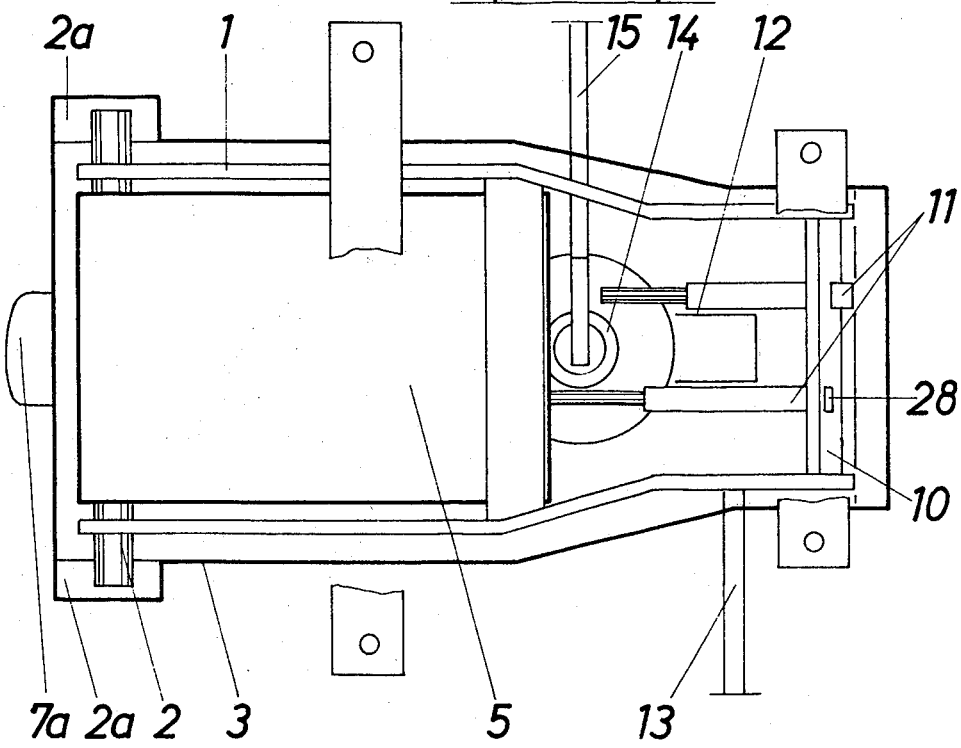
Fig. 1B

Fig. 2A
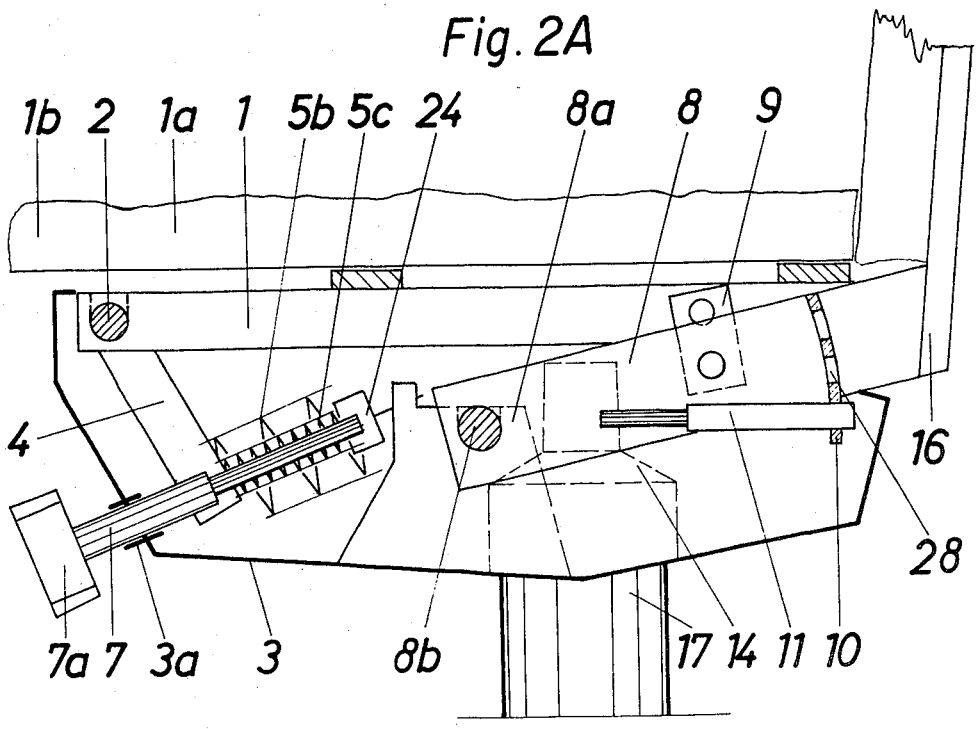
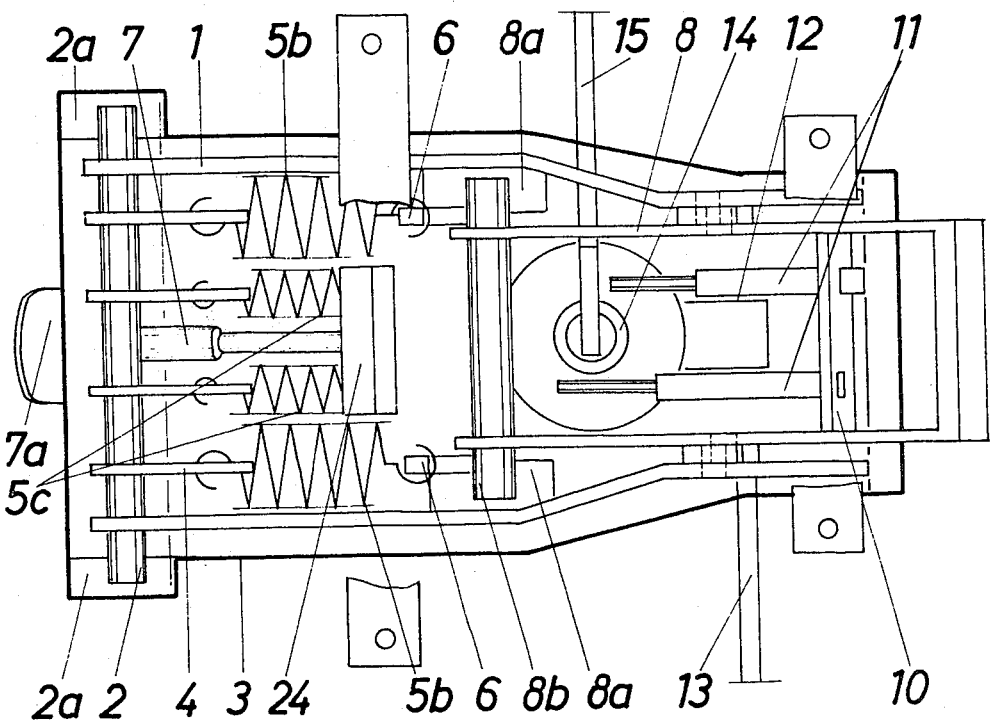
Fig. 2B

Fig. 3A
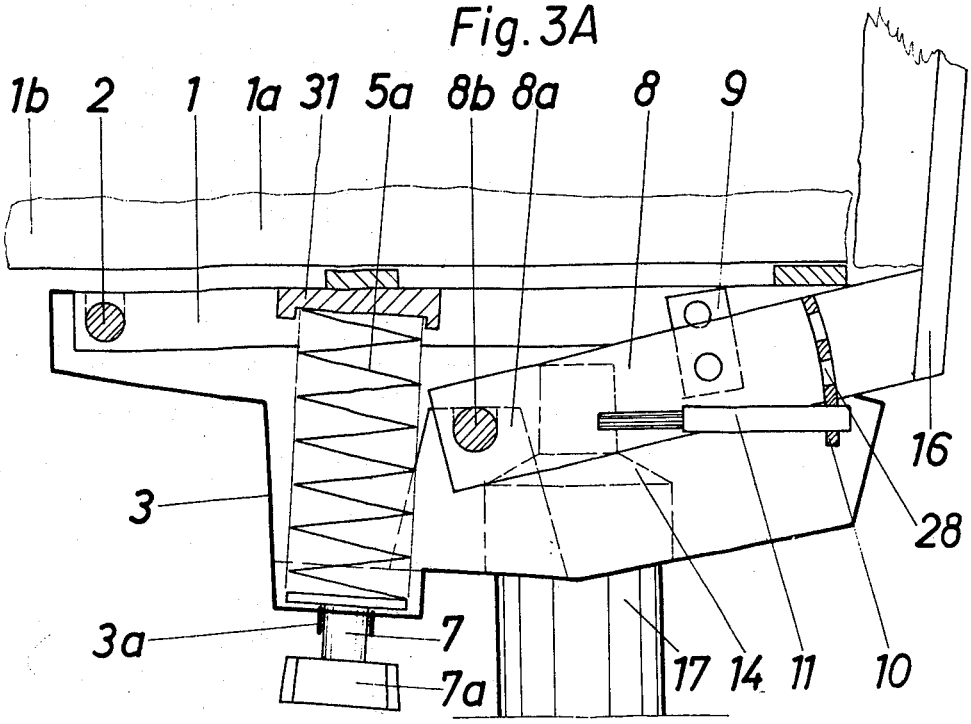
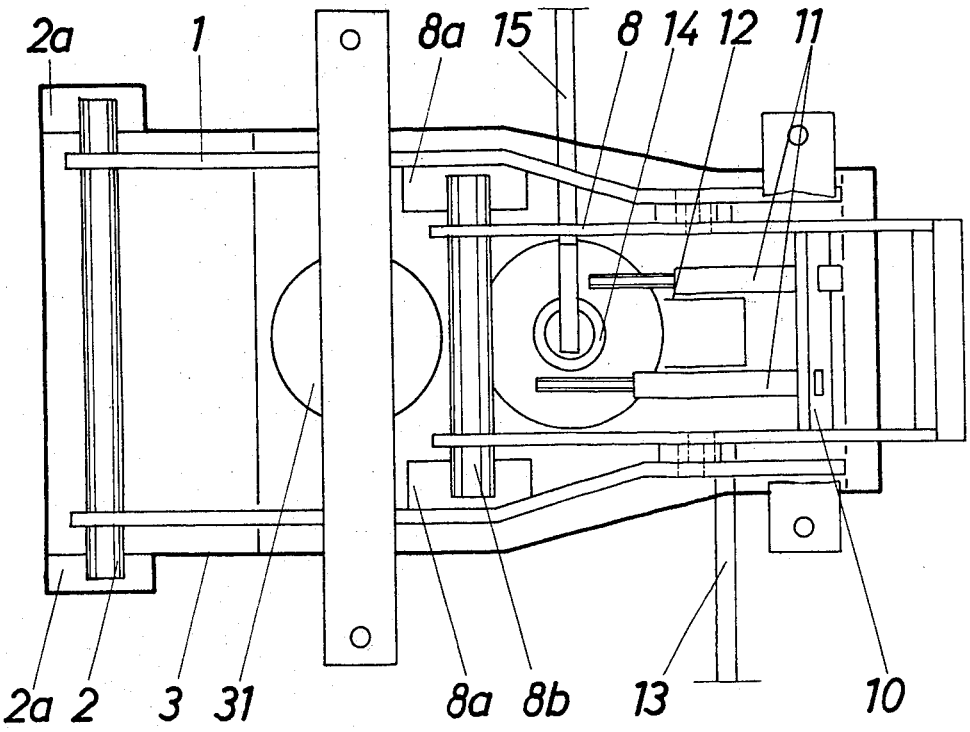
Fig. 3B

Fig. 4A
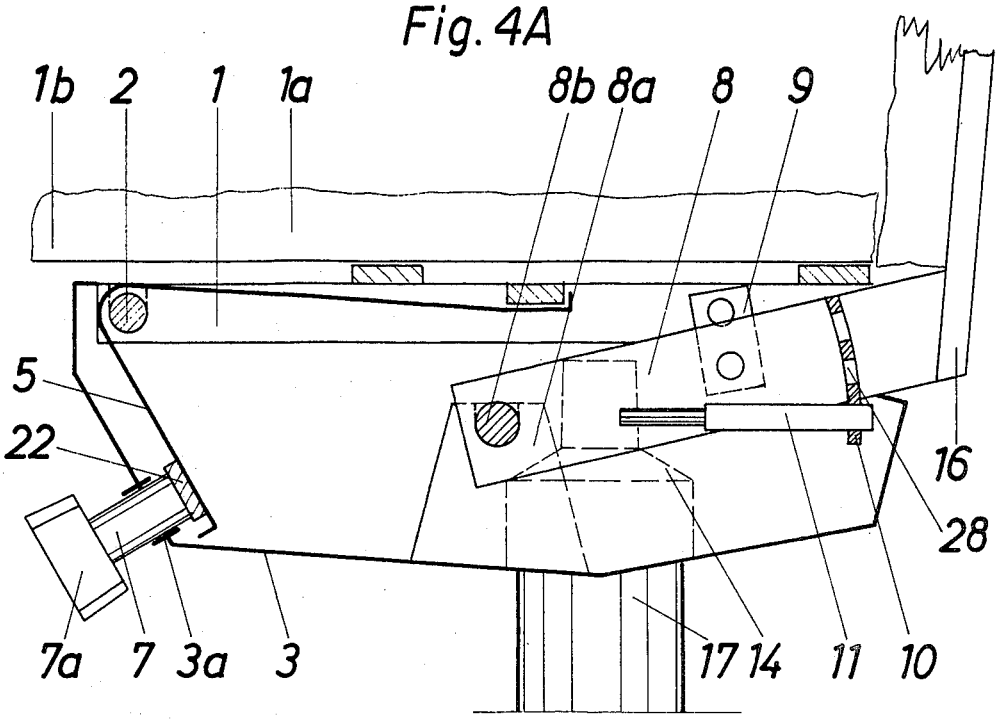
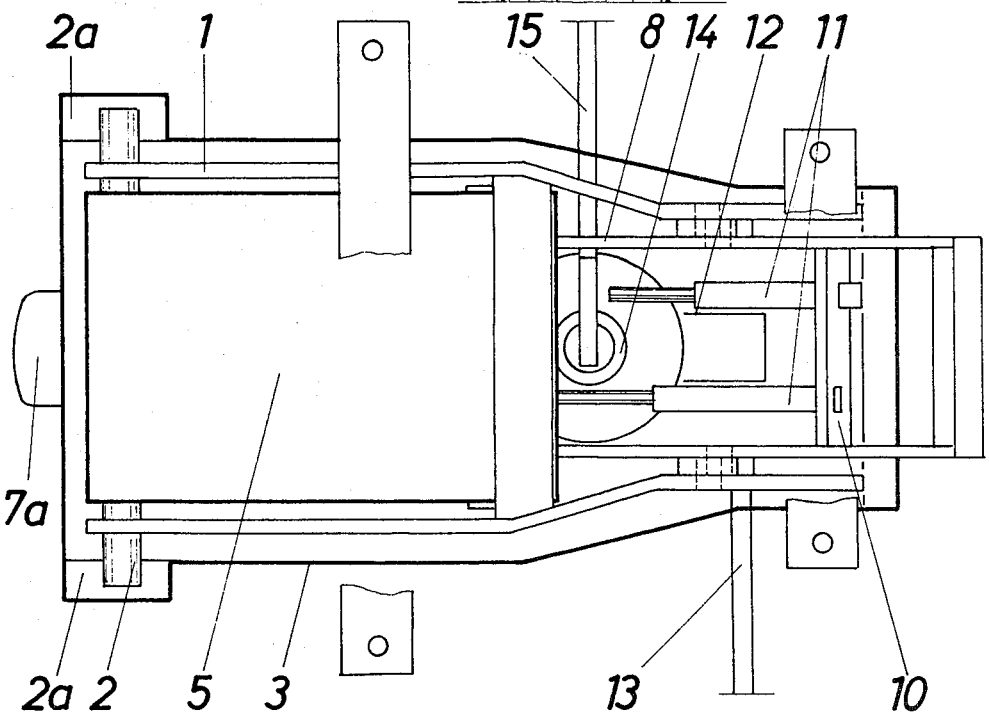
Fig. 4B

Fig.5A
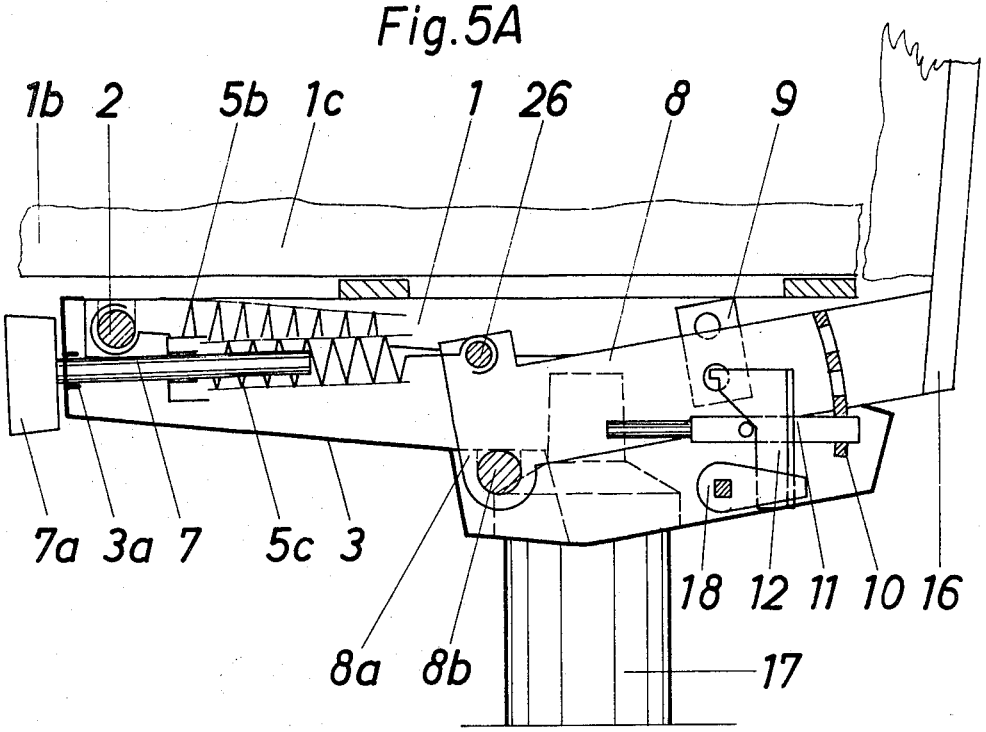
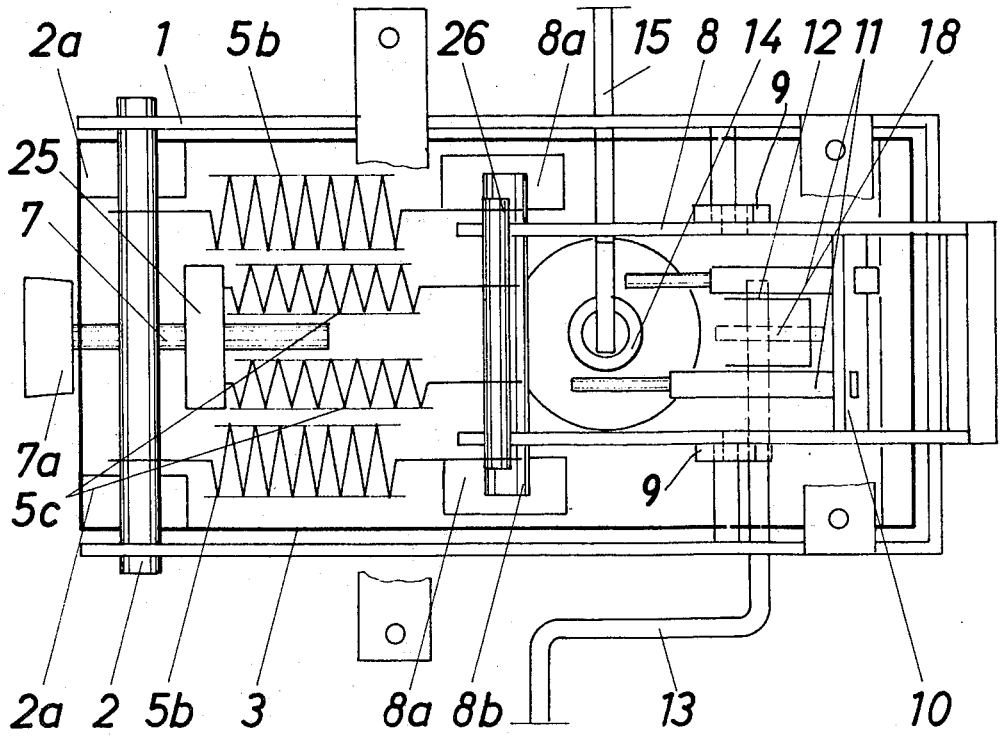
Fig. 5B

Fig. 6A
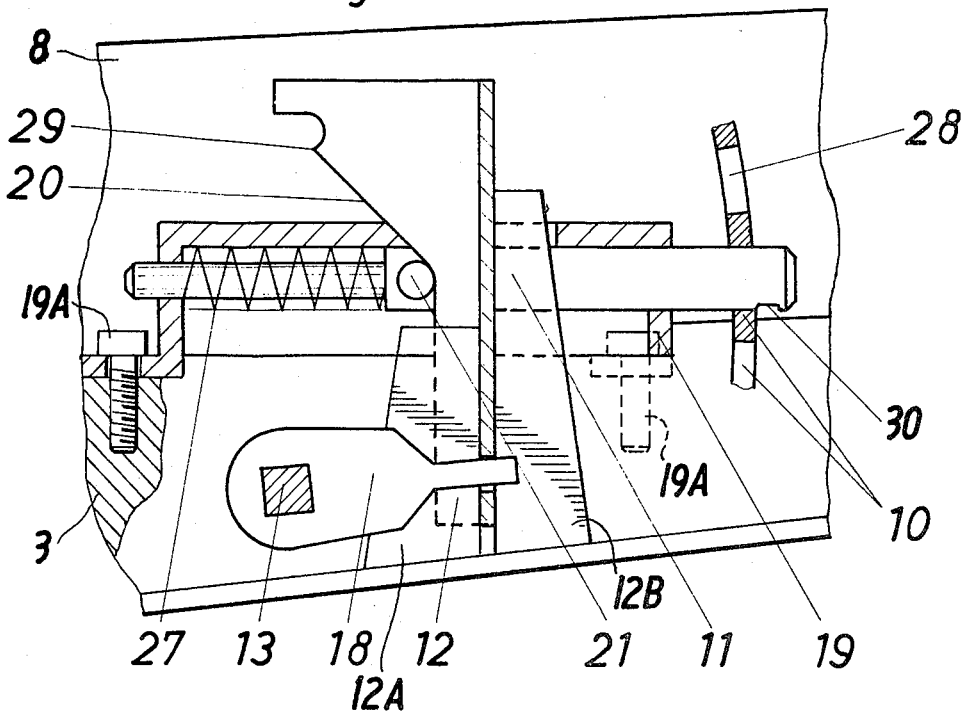
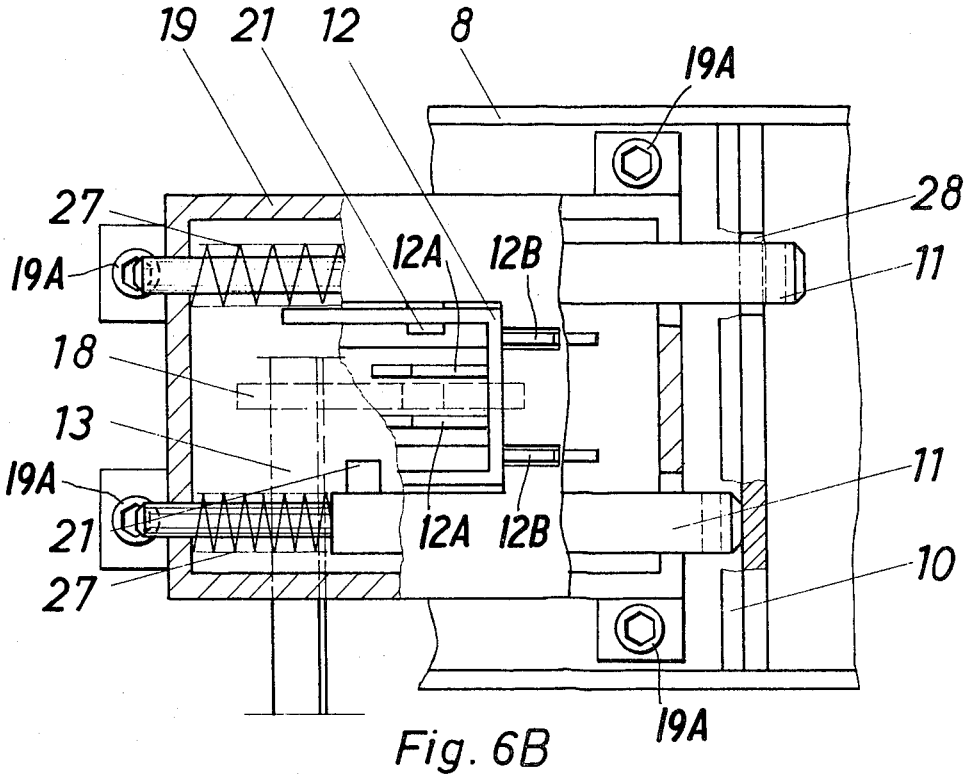
Fig. 6B

TILTING DEVICE FOR SEATING UNITS

BACKGROUND OF THE INVENTION

1. Field of the Invention

The invention concerns a tilting device for seating units and is a continuation-in-part application of U.S. patent application Ser. No. 952,791, filed Oct. 19, 1978, now abandoned.

2. Description of the Prior Art

A tilting device is known from German Utility Pat. No. 75 27 802 and, similarly, a seating unit is set forth in German Pat. No. 23 32 596 where the seat is pivoted around a horizontal axis in the area of the front edge of the seat in supporting arms resting on the understructure and a mechanical locking device and a bolt spring are provided in an arm rest whereby the locking device locks or releases in steps and the bolt spring between the locking device and the seat acts against the force exerted by the user.

A seating unit is further known from German Pat. No. 20 01 097 where the seat is provided around a horizontal axis in the area of the front edge of the seat in a mounting system resting on the understructure whereby the load of the user is received by a pressure spring which is adjustable in its initial compression and which acts between the seat and the mounting system.

German Pat. No. 1 108 870 sets forth a seating unit where the seat is pivoted around a horizontal axis in the area of the front edge of the seat in supporting arms resting on the understructure while the rear part of the seat is supported by rocking levers, provided on the supporting arms, through rollers whereby the load of the user is received by a bolt spring which is adjustable in its spring action and which acts between the swivel axis and the rocking levers.

Finally, a seating unit is known from German Utility Pat. No. 74 01 108 whereby the inclination of the back rest is adjustable by means of a locking device which consists, on the one hand, of negative locking elements arranged in several successive planes vertical to the inclination axis and staggered towards each other and, on the other hand, of positive locking elements engaging into the negative locking elements.

However, the known designs either do not comply at all with today's requirements as to ergonomics and production techniques or are conceived in such a manner that they are only available for a limited number of consumers owing to the technical expenses required for their implementation and the ensuing high price.

SUMMARY OF THE INVENTION

It is therefore an object of the invention to create a tilting device for seating units which permits, in an ergonomically optimized manner, a tightly locked concentrated working position and a relaxed position, with intermediate positions, for the user, on the one hand, such that the user can be seated in a swinging, "dynamic" way against the spring action, while on the other hand and at the same time, gives the possibility of producing, in a production-technically favorable manner, simpler and more comfortable models in the sense of a modular system. By doing so, the tilting device must be optically inconspicuous, of a compact design and it must be possible to attach it under the seat.

The tilting device according to the present invention makes it possible for the user of the seating unit to choose between either a tightly locked working or relaxing position or sensitively controlled, adjustable intermediate positions of the seat and the back rest or, additionally, to be seated "dynamically" by swiveling between working and relaxing position against a spring action acting on the back. By doing so, the spring action can be adjusted in accordance with the individual requirements of the user and the seating surface is lowered towards the relaxing position whereby a sliding forward of the posterior is actually prevented but, at the same time, a lifting of the feet off the floor is also avoided.

When adding to the basic concept of the present invention with a movably connected back rest accordingly, the angle between seat and back, determining the seating angle of the body, is automatically changed with each manner of being seated as a function of the respective tilt of the seat so that, in the working position, a small and, in the relaxing position, a large seating angle is obtained in a physiologically favorable way. By supporting the back rest under the seat in the area of the center of the seat, relative movements between a persons back and the back rest are avoided and thus, the undesirable "shift-take-off-effect" is prevented.

In each case, the tilting device according to the invention results in a surprisingly small unit despite its considerable sturdiness and, since arranged under the seat, being practically not visible.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference numerals designate like or corresponding parts throughout the several views, and wherein:

FIG. 1A shows a partially cut lateral view of a design with a back rest rigidly fastened to the seat and a plate spring;

FIG. 1B shows a top view of the seating removed of a design with a back rest rigidly fastened to the seat and a plate spring;

FIG. 2A shows a partially cut lateral view of a design with a movable back rest and bolt springs acting in the front on the seat carrier;

FIG. 2B shows a top view of a design with a movable back rest and bolt springs acting in the front on the seat carrier;

FIG. 3A shows a partially cut lateral view of a design with a movable back rest and a pressure spring;

FIG. 3B shows a top view with the seating removed of a design with a movable back rest and a pressure spring;

FIG. 4A shows a partially cut lateral view of a design with a movable back rest and a plate spring;

FIG. 4B shows a top view with the seating removed and a design with a movable back rest and a plate spring;

FIG. 5A shows a partially cut laterial view of a design with a movable back rest and bolt springs acting on the shank of the back rest carrier;

FIG. 5B shows a top view with the seating removed of a design with a movable back rest and bolt springs acting on the shank of the back rest carrier;

FIG. 6A shows a partially cut lateral view of a preferred design of the locking device of the tilting device; and FIG. 6B shows a top view with the seating removed of a preferred design of the locking device of the tilting device.

DETAILED DESCRIPTION OF THE PREFERRED EMBODIMENTS

In each of the Figures, a preferably frame-shaped seat carrier 1 rests in bearings 2*a* of a casing 3 through a swivel axis or pivot axis or axle 2. The seat fastened on the seat carrier 1 which, as a rule, is upholstered, is given reference number 1*a*. The bearings 2*a* are arranged in the area of the front edge of the seat 1*b* whereby its level remains constant with an adjustment of the tilt of the seat carrier 1 and a lifting of the thighs of the user resting on the seat being thus avoided.

The casing 3 is vertically adjustably supported by the upright standard 17 of the understructure by means of a taper socket 14 through a gas spring actuated by means of a control lever 15 and consists preferably of sheet metal. However, instead of a gas spring provided with a tapered socket, another type of vertical adjustment device can also be provided, for example, a click-stop device. The casing 3 has a bearing 8*a* or rest member to receive the lower shank of a movable back rest carrier. Furthermore, such includes a guide, shown only in FIGS. 6A and 6B for reasons of simplification, for horizontally movable locking bolts 11, being under spring action, in the form of a locking box 19. Additionally, such has a lead-through bearing in the form of a threaded eye 3*a* for an adjustment element 7 with actuation button 7*a* to adjust the initial compression of the spring elements 5. Finally, an actuation lever 13 is provided which penetrates the casing 3 and acts upon an unlocking slide 12. By its actuation, the unlocking slide 12 is moved up and down whereby a horizontal movement of the locking bolts 11 is obtained over the inclined plane 20 with unlocking bolts 21 sliding on it.

The components described so far represent the basic module of the tilting device according to the invention. When proceeding from this basic module, one can then come to simpler or more comfortable models, preferably only in the final assembly, in a technically favorable manner of production.

A particularly simple, inexpensive design is shown in FIGS. 1A and 1B. Here, the bearing 8*a* on the casing 3 is not utilized and the back rest 23 is rigidly, integrally connected with the seat 1*a*.

A plate spring or the flat spring is used as spring element 5. The initial compression of the spring element can be adjusted in a simple manner by the user by means of actuating the actuation button 7*a*. In this instance, the adjusting element 7, being designed as a screw, acts on the plate spring through a pressure plate 22, with the plate spring resting, on the other hand, on the seat carrier 1 which is designed as a counter-support. The threaded eye 3*a* is incorporated in the casing 3 so that the number of components and the size of the unit are minimized.

The locking plate 10 is fastened to the seat carrier 1. By actuating the lever 13, either one of the locking bolts 11 comes to rest in a locking hole 28 of the locking plate 10 so that the tilt of the seat 1 is locked in the selected position or all locking bolts 11 are released so that the user of the seating unit can be "dynamically" seated in a swiveling manner against the force of the spring element 5.

The special advantages of locking device comprising the locking plate 20 and the locking bolts 11, such as sensitively controlled steps, sturdiness and compactness, will be still further described in connection with FIGS. 6A and 6B.

Proceeding from the simple design according to FIGS. 1A and 1B, the more comfortable design according to FIGS. 2A and 2B can be achieved without special production-technical expenses by the fact that in this embodiment the lower shank 8 of a bell-crank back rest carrier 16 rests in the bearing 8*a*, which is not utilized in FIGS. 1A and 1B, by means of the swivel axis or axle 8*b* parallel to the swivel axis 2 of the seat carrier 1.

The swivel axis or axle 2 of the seat carrier 1 has several levers 4 at the end of which, away from the axis, spring elements are suspended in the form of bolt springs 5*b*, 5*c*, the other ends of which are partially fixed on fastening eyes 6 and partially on a ledge 24. The initial tension of the springs 5*c* fixed on the ledge 24 can be adjusted by the user. The initial tension of the springs 5*c* fixed on the ledge 24 can be adjusted by the user, in accordance with his individual requirements, by means of the adjustment element 7 by actuating the actuation button 7*a* with springs 5*c*, in turn, being not adjustable.

The utilization of several bolt springs 5*b*, 5*c*, if possible of the same design, has two particular advantages. On the one hand, the space required for their installation can be kept small and short in spite of large overall spring forces. On the other hand, in order to match the spring force with the constitution of the user, it is sufficient to have only one or two springs 5*c* adjustable which leads to low operating forces and a simple design of the adjusting device.

The seat carrier 1 is movably connected with the back rest carrier shank 8 at its side away from the axis through a cover plate or link member 9. The location of this connection is chosen in such a manner that the distance between the swivel axis or axle 2 of the seat carrier 1 and the cover plate 9 is about twice the distance between the cover plate 9 and the swivel axis or axle 8*b* of the back rest carrier shank 8. This results in an adjustment ratio of the back rest carrier 16 to the seat carrier 1 of about 2:1, i.e. a certain tilting angle of the seat carrier 1 results in a tilting angle of the back rest carrier 16 having twice the size. This forced tilting adjustment takes into consideration today's knowledge of ergonomics. By means of the actuation lever 13, again either a locked, sensitively adjustable "static" seating or a swiveling, "dynamic" seating, against the forces of the springs 5*b*, 5*c*, can be obtained.

In the case of the design shown in FIGS. 3A and 3B, the seat back rest arrangement corresponds with that of FIGS. 2A and 2B but the load of the user is, in this instance, received by a pressure spring 5*a* which rests below on the casing 3 and, on the top, on a counter-bearing 31 arranged on the seat carrier 1. Instead of one pressure spring, also several, preferably concentrically arranged pressure springs can be provided. The adjustment of the spring force is effected through the adjusting element 7, being designed as a screw, and its actuation button 7*a*. The adjusting element 7 penetrates the casing 3 in the threaded eye 3*a*.

In FIGS. 4A and 4B, the load of the user is received by a spring element 5 designed as a plate spring as in FIGS. 1A and 1B but the design according to FIGS. 4A and 4B has, instead a rigid back rest carrier, uses a movable back rest carrier 16 connected with the seat carrier 1 through the cover plate 9 as in FIGS. 2A and 2B as well as FIGS. 3A and 3B.

A last, particularly preferred design of the invention is shown in FIGS. 5A and 5B. In this case, the load of the user, transferred from the seat carrier 1 over the cover plate 9 to the back rest carrier shank 8, is received by spring elements designed as bolt springs **5*b*, 5*c* which are suspended from the end, away from the axis, of a lever piece 26 attached to the back rest carrier shank 8. At their other ends, the non-adjustable springs 5*b* are suspended from the swivel axis 2 of the seat carrier 1 and the adjustable springs 5*c* are suspended from a ledge 25 which is placed on the adjusting element 7** designed as a screw.

The great advantages of the design according to FIGS. 5A and 5B are particularly found in the fact that the casing 3 can be designed very flat in its front part and rocking against the component can be avoided to a large extent which might occur owing to the pitching motion developing when the user gets off the seat. The disadvantage that, in case of a design of the seating unit with rigid, integral back rest 23 as in FIGS. 1A and 1B, (the back rest carrier shank 8 cannot be eliminated here) is overcome by the mentioned advantages.

In FIGS. 6A and 6B, the locking device comprising the locking plate 10 and the locking bolts 11, which was only implied in the other figures, is shown greater detail. As can be seen there are two horizontally movable locking bolts 11 in a locking box 19 fixed to the casing 3 by members 19A and which are pushed against the locking plate 10 fastened to the end away from the axis of the back rest carrier shank 8 by means of locking springs 27. The locking plate 10 has, for each bolt 11, a row of successive locking holes 28 whereby the rows of holes are staggered against each other up to half of their size so that always only one of the locking bolts 11 located in the same horizontal plane can engage into a locking hole 28 to secure the seating position in a variety of first stable or operable position. By means of this alternate locking of the locking bolts 11, on the one hand, a very sensitive graduation, below human perception, is achieved in the seating positions to be adjusted but, on the other hand, the overall size of the components can, nevertheless, be kept remarkably small in spite of a strong design of the bolts 11 and of the holes 28.

Unlocking slide 12 is supported for movement in an upward and downward direction by a first and second pair of support plates 12A and 12B, respectively, connected to casing 3. When slide 12 moves upward or downward, edge portions thereof slidably cooperate with adjacent edge portions of support plates 12A and 12B.

As already mentioned above, the horizontal movement of the bolts 11 are achieved by the fact that horizontal forces are exerted on the releasing bolts 21 attached to the locking bolts 11 over the inclined plane 20 of the unlocking slide 12 when it moves up and down so as to move locking bolts 11 back and forth. When the unlocking slide 12 is pushed all the way down owing to the actuation of the lever 13, both bolts 11 engage in their final position by engagement of the bolts 21 behind the cam 29 of the unlocking slide 12. This results in the second stable or operable position of the bistable actuation lever 13 in which a swiveling, "dynamic" seating becomes possible. So that the bolts 11 cannot simply jump out of an engaged position in a locking hole 28, each include a cam 30 which permits them to leave their locking hole 28 only when the lever 13 is actuated, i.e. when the user pushes against the back rest and thus slightly lowers the locking plate 10.

Overall, the tilting device according to the invention represents an independent, compact component to be attached underneath the seat and can be fastened underneath numerous kinds of different upper parts of chairs and easy chairs which have or do not have arm rests. The locking device operates fully mechanically and is form-locking such that it is sturdy and lasting. The equalization and return spring system consists, to its full extent, of reliable and inexpensive mechanical springs.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A tilting device for a seating unit which comprises:

a casing disposed beneath a seat resting on the understructure of the seating unit;

a seat carrier pivotably mounted about a horizontal swivel axis to the front edge area of said seat;

mechanical locking means for connecting the seat carrier within the casing including first locking members and second locking members engageable with said first locking members;

means for biasing said second locking members into engagement with said first locking members;

means for guiding said second locking members into and out of engagement with said first locking members;

sliding means for moving said second locking members so as to engage with said first locking members;

a rest member pivotably adjustably mounted to said casing;

a lever member operatively associated with said casing;

a bearing member connected to said casing operably engageable with said rest member;

a plurality of spring elements mounted on said casing which acts at one end of the seat carrier opposite to the load of the user;

bistable activation lever means connected to said sliding means for activating said mechanical locking means, accessible to the user of the seating unit in such a manner that, in a first operable position, said second locking members are disengaged from said first locking members and, in a second operable position, at least one of said second locking members is engaged with said first locking members;

means extending outside said casing for adjusting the initial tension of said plurality of spring elements from outside said casing mounted on said casing; and said first locking members comprise a locking plate operatively associated with the seat carrier including holes formed in said locking plate and wherein said second locking member comprises locking bolts, supported by the means for guiding the second locking means, engageable in said holes formed in said locking plate and wherein only one part of said plurality of spring elements is adjustably connected to said lever for initial tension by said adjusting means.

2. A tilting device for a seating unit which comprises:

a casing disposed beneath a seat resting on the understructure of the seating unit;

a seat carrier pivotably mounted about a horizontal swivel axis to the front edge of said seat;

mechanical locking means for connecting the seat carrier within the casing including first locking members and second locking members engageable with said first locking members;

means for biasing said second locking members into engagement with said first locking members;

means for guiding said second locking members into and out of engagement with said first locking members;

sliding means for moving said second locking members so as to engage with said first locking members;

a bell-crank back rest carrier pivotably adjustably connected to said casing including a shank member;

a lever member connected to said shank member;

a bearing member connected to said casing operably engageable with said shank member of the back rest carrier;

a plurality of spring elements mounted on said casing which acts at one end of the seat carrier opposite to the load of the user;

bistable activation lever means connected to said sliding means for activating said mechanical locking means, accessible to the user of the seating unit in such a manner that, in a first operable position, said second locking members are disengaged from said first locking members and, in a second operable position, at least one of said second locking members is engaged with said first locking members;

means extending outside said casing for adjusting the initial tension of said plurality of spring elements mounted on said casing;

a link member movably interconnecting the seat carrier with said shank member of the back rest carrier disposed in an area of the seating unit away from the swivel axis of the seat carrier so as to provide a second swivel axis for the back rest carrier member parallel to the swivel axis of the seat carrier; wherein said first locking members comprise a locking plate connected to the rear portion of the shank member of the back rest carrier member including holes formed in said locking plate and said second locking member comprises locking bolts, supported by the means for guiding the second locking means engageable in said holes formed in said locking plate and wherein only one part of said plurality of spring elements is adjustably connected to said lever for initial tensioning by said adjusting means.

3. The tilting device of claim 2 wherein the distance between the swivel axis of the seat carrier and the link member connecting the seat carrier with the shank member of the back rest carrier member is approximately twice the distance between the link member and the swivel axis of the shank member of the back rest carrier.

4. A tilting device as set forth in claims 1 or 2, which further comprises:

a lever connected to the seat carrier at the swivel axis of the seat carrier; and fastening eye members mounted on the casing wherein said plurality of spring elements interconnect the lever and the fastening eye members.

5. A tilting device as set forth in claim 2, said shank member further comprising:

a lever member disposed on the swivel axis of said bell crank back rest carrier and wherein said plurality of spring elements interconnect said lever member and the casing.

* * * * *